United States Patent [19]

Fukatsu

[11] Patent Number: 4,644,314

[45] Date of Patent: Feb. 17, 1987

[54] PORCELAIN CLAD CURRENT TRANSFORMER

[75] Inventor: Takeo Fukatsu, Amagasaki, Japan

[73] Assignee: Mitsubishi Denki Kabushiki Kaisha, Tokyo, Japan

[21] Appl. No.: 868,384

[22] Filed: May 29, 1986

[30] Foreign Application Priority Data

Jun. 4, 1985 [JP] Japan ..... 60-83408[U]

[51] Int. Cl.[4] ..... H01F 27/14

[52] U.S. Cl. ..... 336/58; 336/147

[58] Field of Search ..... 336/173, 174, 175, 55, 336/57, 58, 60, 62, 94, 192, 145, 146, 147, 90; 174/18, 11 BH, 12 BH, 14 BH, 12 R

[56] References Cited

U.S. PATENT DOCUMENTS

| | | | |
|---|---|---|---|
| 3,028,568 | 4/1962 | Camilli | 336/58 X |
| 3,668,513 | 6/1972 | Tsubouchi et al. | 336/174 X |
| 4,052,685 | 10/1977 | Kolator | 336/62 X |

*Primary Examiner*—Thomas J. Kozma

*Attorney, Agent, or Firm*—Sughrue, Mion, Zinn, Macpeak and Seas

[57] ABSTRACT

An expansion chamber 23 for a porcelain clad current transformer is formed by a base plate 231 secured on an insulating tube 22 housing a primary coil 21, and a unitary inverted cup-shaped envelope 232 removably mounted on the upper surface of the base plate. Primary terminals 26electrically connected to the coil within the expansion chamber are installed through the base plate to thereby facilitate the necessary connections before the chamber is assembled and filled with insulating oil.

5 Claims, 6 Drawing Figures

PORCELAIN CLAD CURRENT TRANSFORMER

BACKGROUND OF THE INVENTION

This invention relates to a porcelain clad current transformer having an expansion chamber filled with insulating oil and gas.

FIG. 1 shows a sectional view of an expansion chamber in a conventional current transformer of this kind as disclosed by Japanese Utility Model Publication No. 28100 of 1965, wherein a primary coil 1 is disposed in an insulating tube 2. The expansion chamber 3 is defined by an upper flange 31, a cylindrical side plate 32 and a base plate 33, and the assembly is secured to the top of the insulating tube via the base plate. A cover 4 is attached over the flange with bolts 6 passing through a packing 5.

Current is supplied to the primary coil 1 through terminals 7 secured through the side plate 32 of the chamber and connected to lead straps 8. Each terminal 7 is mounted on a terminal board 9 outside of the expansion chamber.

Insulating oil 10 for cooling the primary coil fills the insulating tube 2 and most of the expansion chamber 3. The upper portion of the chamber is filled with nitrogen gas 11 to absorb any pressure increase caused by the thermal expansion of the insulating oil. To improve heat dissipation a finned radiator 12 is welded around the side plate 32 of the expansion chamber.

To assemble such a conventional current transformer the primary terminals 7 are first mounted through the side plate 32, and the base plate 33 of the expansion chamber is then bolted onto the insulating tube 2. The lead straps 8 are next connected between the primary coil 1 and the terminals 7, whereafter the cover 4 is bolted onto the flange 31 through the packing 5. Finally, the insulating oil 10 and nitrogen gas 11 are supplied to and sealed within the expansion chamber.

Such a conventional porcelain clad current transformer has some drawbacks, however, as described below. First of all, the lead straps 8 have to be installed by inserting them manually from the relatively remote area of the flange 31, which makes the assembling job difficult and time consuming. Secondly, the inner edge of the packing 5 is always in contact with the nitrogen gas 11, and the resulting deterioration of the packing hampers its leak protection properties. Thirdly, the expansion chamber occupies a relatively large vertical space due to the radiator 12 and the primary terminals 7 both being mounted on its side plate 32. Finally, the side plate has to be made of an expensive non-magnetic material to reduce heat generation caused by structural loss accompanied by penetrating current flow through the side plate.

SUMMARY OF THE INVENTION

It is therefore an object of this invention to provide a porcelain clad type of current transformer in which the installation of the lead straps is simplified, no gas leakage is observed, and the expansion chamber can be reduced in size.

This object is accomplished by providing a base plate mounted on an insulating tube, and a unitary expansion chamber envelope in the form of an inverted cup secured on the upper surface of the base plate such that it may be easily removed and replaced. The envelope covers the base plate when installed, and the primary terminals are mounted through the base plate rather than the side plate. Such a disposition of the primary terminals enables the expansion chamber envelope to be constructed of inexpensive material, with non-magnetic material being required only for the base plate.

DETAILED DESCRIPTION OF THE PREFERRED EMBODIMENTS

Figure 1:
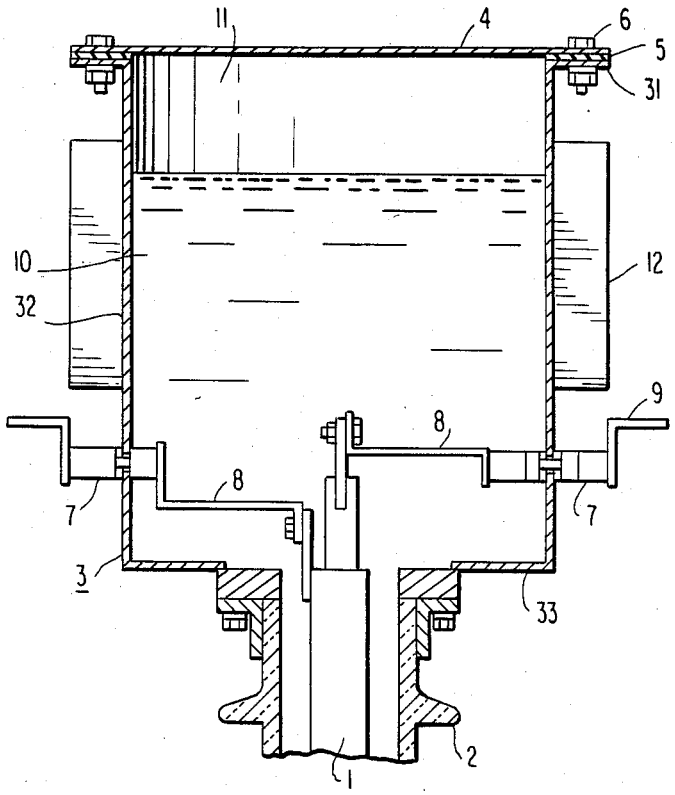
FIG. 1 PRIOR ART
FIG. 1 is a partial vertical sectional view of a conventional porcelain clad type of current transformer.
Figure 2:
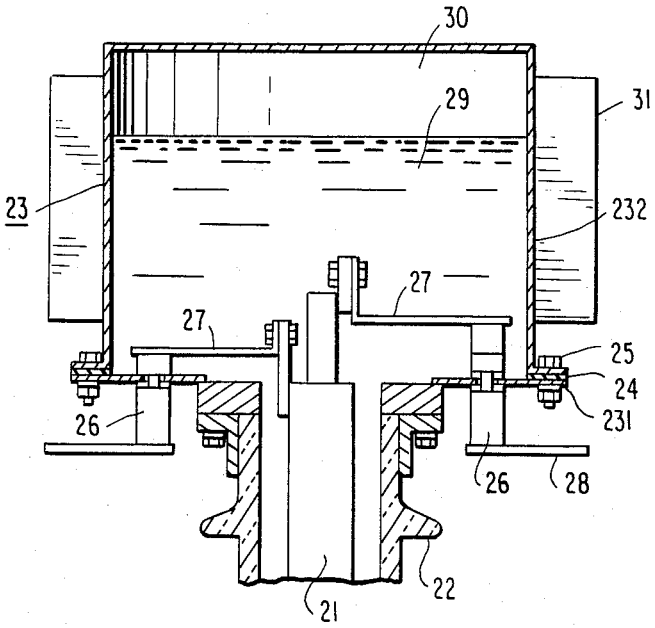
FIG. 2 is a similar view of a current transformer according to one embodiment of the present invention.
Figure 3:
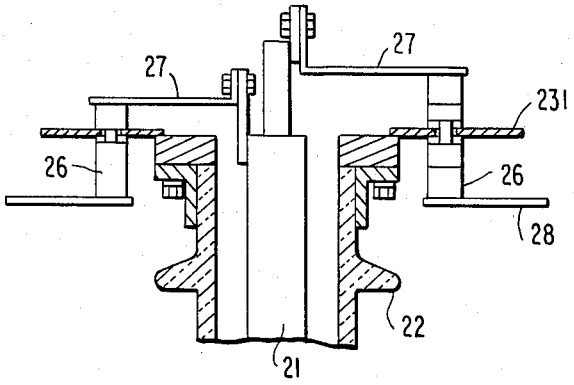
FIG. 3 is an enlarged sectional view showing the connection between the primary terminals and the primary coil in FIG. 2.

Referring to FIGS. 2 and 3, a primary coil 21 is housed in an insulating tube 22, on which a base plate 231 is mounted. A unitary expansion chamber envelope 232 is mounted on the base plate with bolts 25 extending through a packing 24. The base plate and envelope form an expansion chamber 23. Primary terminals 26 for supplying current to the primary coil 21 are mounted through the base plate 231, and lead straps 27 are connected between the coil and the terminals.

Each primary terminal 26 is mounted on a terminal board 28 below the expansion chamber. The insulating tube 22 and expansion chamber contain insulating oil 29 for cooling and insulating the primary coil 21. The upper portion of the expansion chamber 23 is filled with nitrogen gas 30 for absorbing pressure increases caused by the thermal expansion of the insulating oil. The oil and gas may be charged into the chamber through any conventional and sealable aperture in the envelope, not shown. To improve heat dissipation a finned radiator 31 is welded to the outer surface of the envelope 232.

In the assembly of such a porcelain clad current transformer, since the lead straps 27 can be connected with the envelope 232 removed as shown in FIG. 3, a large working space is available to facilitate the installation work. Furthermore, as the primary terminals 26 are installed on the base plate 231, the vertical height of the envelope 232 can be reduced in comparison with the conventional construction and the expansion chamber 23 is thus more compact and lighter in weight.

The use of expensive non-magnetic material can also be limited to the base plate 231 to reduce the manufacturing cost. In addition, a hermetic seal provided between the base plate 231 and the envelope 232 by the packing 24 is only exposed to the insulating oil 29, which eliminates any gas leak and packing deterioration problems.

Figure 4:
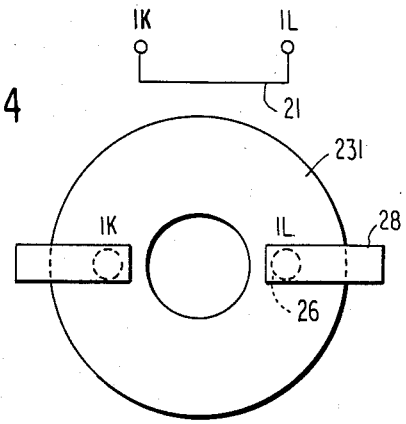
FIG. 4 is a schematic bottom view showing the constructional relation between the primary terminals and the base plate in FIG. 2.
Figure 5:
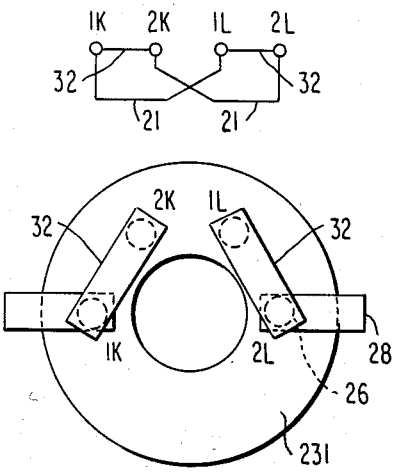
FIG. 5 is a similar schematic bottom view where a dual primary coil connected in parallel is used.
Figure 6:
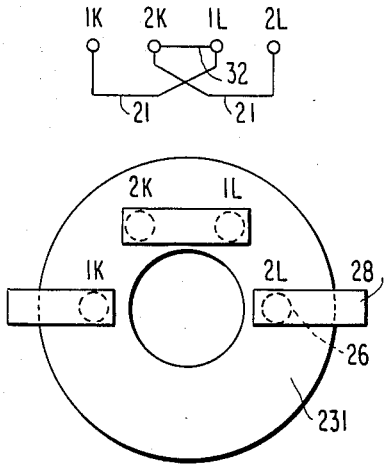
FIG. 6 is a similar schematic bottom view where a dual primary coil is connected in series.

Although the primary coil 21 of the above embodiment is configured as a single conductor as schematically shown in FIG. 4 in which no current change is required, it may also be configured as a dual or split conductor to implement changing the ratio of current transformation. Such split coils may be connected in parallel using two terminal straps 32 as shown in FIG. 5, or in series using a single strap as shown in FIG. 6. The external disposition of the strap(s) below the base plate facilitates any necessary changeover without requiring the disassembly of the expansion chamber.

What is claimed is:

1. A porcelain clad current transformer, comprising:

(a) a vertically oriented insulating tube (22), (b) a primary coil (21) disposed within the tube, (c) a centrally apertured, generally planar base plate (231) sealingly mounted to an upper end of the tube such that electrical connection terminals for the coil extend upwardly through the aperture, (d) a unitary envelope (232) sealingly mounted to an outer upper periphery of the base plate and defining therewith a closed expansion chamber (23), (e) a charge of insulating oil (29) filling the tube and a lower portion of the chamber, (f) a charge of insulating gas (30) filling an upper portion of the chamber above the oil, (g) at least one primary terminal (26) sealingly mounted to and extending upwardly through the base plate, and (h) conductor means (27) disposed within the chamber connecting a coil terminal to the primary terminal.

2. A transformer according to claim 1, wherein the envelope is configured as an inverted cup, and a lower flange of the cup is bolted to the base plate.

3. A transformer according to claim 2, wherein the base plate is made of non-magnetic material, and the gas is nitrogen.

4. A transformer according to claim 2, wherein the coil comprises two half-windings, and further comprising conductor means (32) for selectively connecting the windings in series or in parallel.

5. A transformer according to claim 3, wherein the coil comprises two half-windings, and further comprising conductor means (32) for selectively connecting the windings in series or in parallel.

* * * * *